United States Patent [19]

Chen

[11] Patent Number: 4,986,792

[45] Date of Patent: Jan. 22, 1991

[54] VIOLIN MUSICAL TOY

[76] Inventor: Chen-Hsiung Chen, No. 209-2, Chien Kang Road, Tainan, Taiwan

[21] Appl. No.: 471,447

[22] Filed: Jan. 29, 1990

[51] Int. Cl.[5] ..... A63H 3/52; A63H 5/00; A63H 3/28

[52] U.S. Cl. ..... 446/408; 446/404; 446/302

[58] Field of Search ..... 446/408, 404, 397, 297, 446/299, 302

[56] References Cited

U.S. PATENT DOCUMENTS

| | | | |
|---|---|---|---|
| 3,153,364 | 10/1964 | Ryan | 446/408 |
| 3,524,377 | 8/1970 | Desmond | 446/408 X |
| 3,550,495 | 12/1970 | Shotmeyer | 446/408 X |
| 3,733,741 | 5/1973 | Pipa | 446/408 |
| 3,808,733 | 5/1974 | Pipa | 446/408 |
| 4,088,050 | 5/1978 | Appel | 446/408 X |
| 4,355,483 | 10/1982 | Korzelius | 446/484 |
| 4,451,911 | 5/1984 | Klose et al. | 446/484 X |

*Primary Examiner*—Robert A. Hafer
*Assistant Examiner*—D. Neal Muir
*Attorney, Agent, or Firm*—Lowe, Price, LeBlanc, Becker & Shur

[57] ABSTRACT

This invention relates to a violin musical toy and in particular to one having string-simulating plates similar to strings of a violin, a control circuit, an engaging member, two copper plates, several keys, a selecting switch, a musical switch and a bow. By drawing the bow on the string plates of the engaging member, like playing a violin, the engaging member will be forced to swing to the left and right side and two protuberances on two ends side of the engaging member will make the two copper plates touch each other continuously which triggers the control circuit to output preset music if the function selecting switch is placed at its, 'AUTO' position. By switching the selecting switch to 'MANUAL' position, the player may press any one of the keys to output a single tone or any two of the keys at the same time and the violin will output a chromatic scale.

4 Claims, 5 Drawing Sheets

VIOLIN MUSICAL TOY

BACKGROUND OF THE INVENTION

It is found that most of the toys on sale have only one purpose that is to entertain children and they seldom have educational function which should be an important consideration when designing toys today.

Therefore, it is an object of the present invention to provide a violin musical toy which will play a preset musical selection or a single tone as desired.

SUMMARY OF THE INVENTION

It is the primary object of the present invention to provide a violin musical toy which is an educational toy to allow children to produce their own rhythm.

It is another object of the present invention to provide a violin musical toy which may inspire children's interest in music.

It is still another object of the present invention to provide a violin musical toy which is easy for children to play the preset music.

It is a further object of the present invention to provide a violin musical toy which is inexpensive to produce.

DETAILED DESCRIPTION OF THE PREFERRED EMBODIMENT

Figure 1:
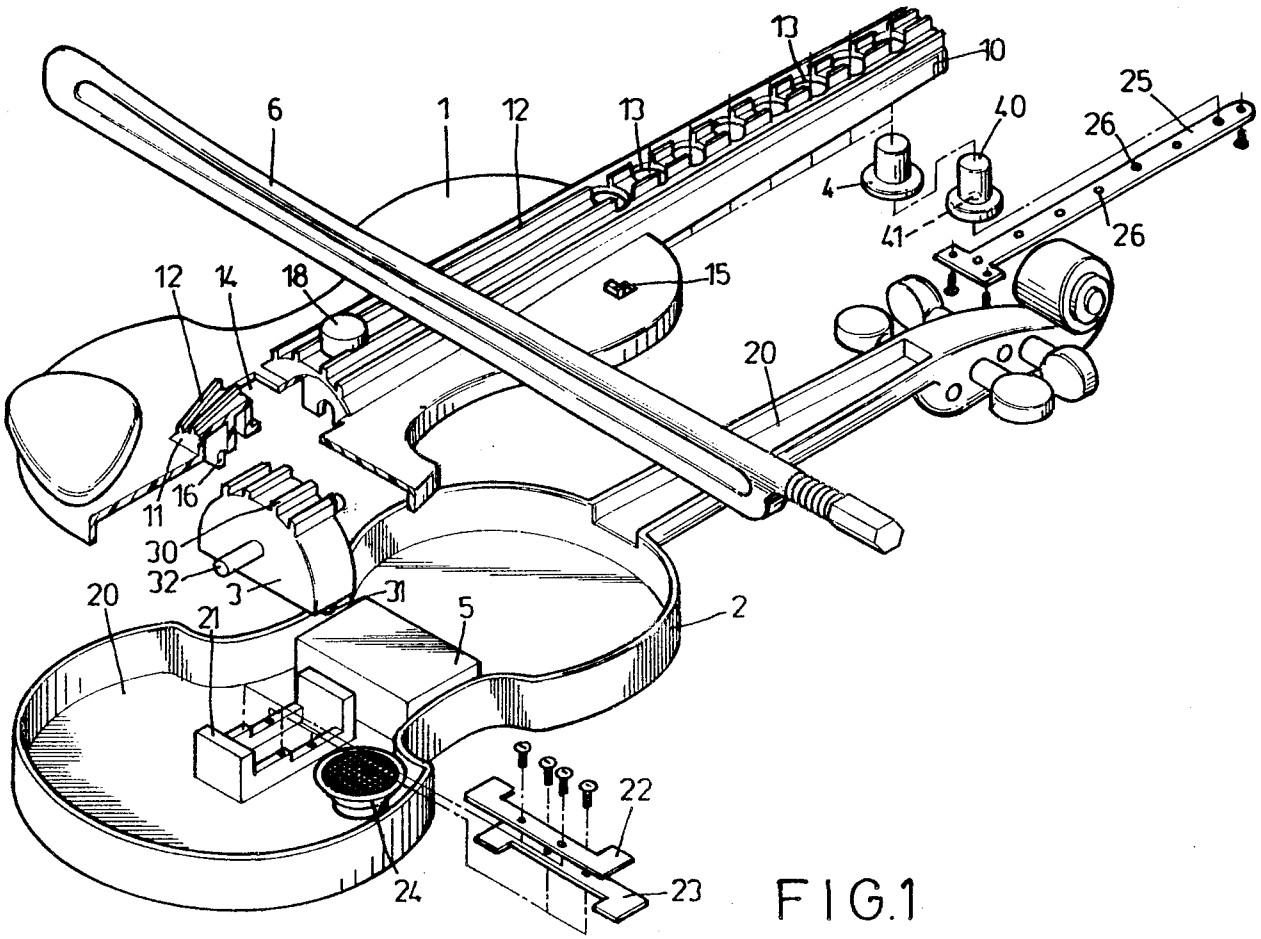
FIG. 1 is a breakdown view of the present invention.

Reference is now made to the drawings and in particular to FIG. 1 the present invention comprises a cover 1 having a bulgy portion 10 at its front and a bridge 11 at its rear end and several string plates 12 placed on them and a square hole 14 inbetween the bulgy portion 10 and the bridge 11. There are several key holes 13 between string-simulating plates 12 on the the bulgy portion 10, a function selecting switch 15, two troughs 16, a song selecting switch 18 and several posts 17 which extend downward from the sides of the key holes 13; a body Z having a groove 20, a mounting 21, two copper plates 22 & 23 aligned with the hole 14 of the cover 1, a speaker 24 at right side of the mounting 21 and a key board 25 placed at the front end of the body 2. There are several contact points 26 on the key board 25, each point aligned with a key hole 13; an engaging member 3 having several string plates 30 on top, two protuberances 31 at its bottom and two axles 32 at two sides; several keys 4 each having a hollow portion at its inside half way from bottom to top to accommodate a block 40 which has half insert into said hollow portion and which has an electric rubber conductor 41 at the center bottom and a portion of elastic body; a control circuit 5 having a trigger circuit 50, a logic control 51, a melody ROM 52, a song select 500, a tone control 53, an oscillating generator 54, a tone generator 55, a buffer 56, a resistor 57, a variable resistance 58, a transistor 59 (shown as in FIG. 5) and a bow 6.

Figure 2:
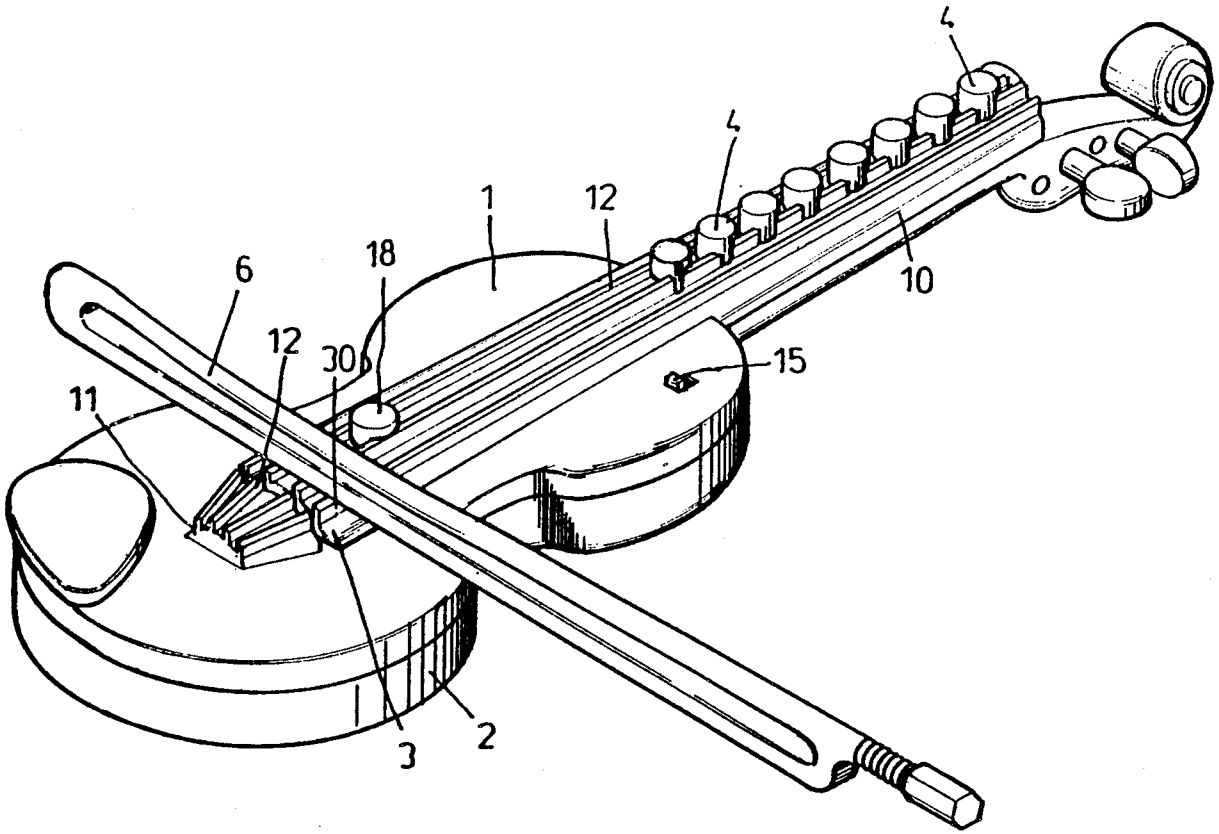
FIG. 2 is a perspective view of the present invention.

When assembling, firstly, place the two copper plates 22 & 23 on the mounting 21 as can be seen that the mounting was made of two different high levels and therefore, the copper plate 22 will be fixed at a higher position and the plate 23 will be at lower position. Then place the engaging member 3 in the groove 20 of the body 2 with the two axles 32 on the mounting 21 which can be limited by the trough 16. Secondly, connect the two copper plates 22 & 23 to the trigger circuit 50 of the control circuit 5 respectively as the input terminal of this invention and place the key board 25, the control circuit 6 and the speaker 24 in the groove 20 and connect the speaker 24 with the output terminal of this invention. Thirdly, connect the contact point 56 with transistor 57 as the tone control 53 of the control circuit 5 and connect the input terminal of the function selecting switch 15 with the logic control 51 while the output terminal is connected to the melody ROM 52 and the tone control 53 then place all the keys 4 in the key holes 13 of the cover 1 and the blocks 40 into the hollow portion of the keys 4 with their elastic bodies face down and placed on the key board 25. Lastly, connect the cover 1 with the body 2 together and the assembling procedure has been completed (shown as in FIG. 2).

Figure 3A:
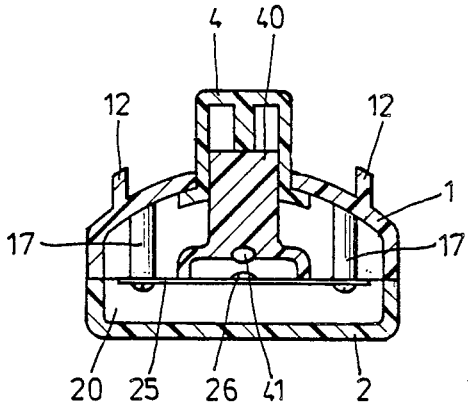
FIG. 3A and 3B are cross-sectional views of a key of the Present invention.
Figure 3B:
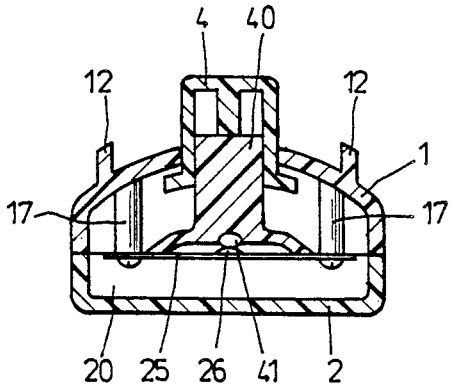
Figure 4A:
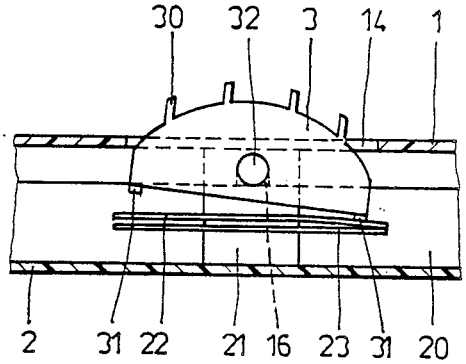
FIG. 4A and 4B are cross-sectional views of an engaging member of the present invention.
Figure 4B:
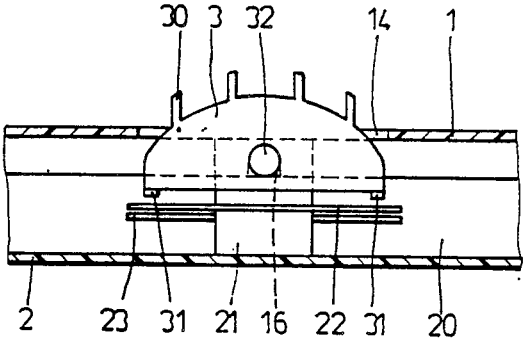
Figure 5:
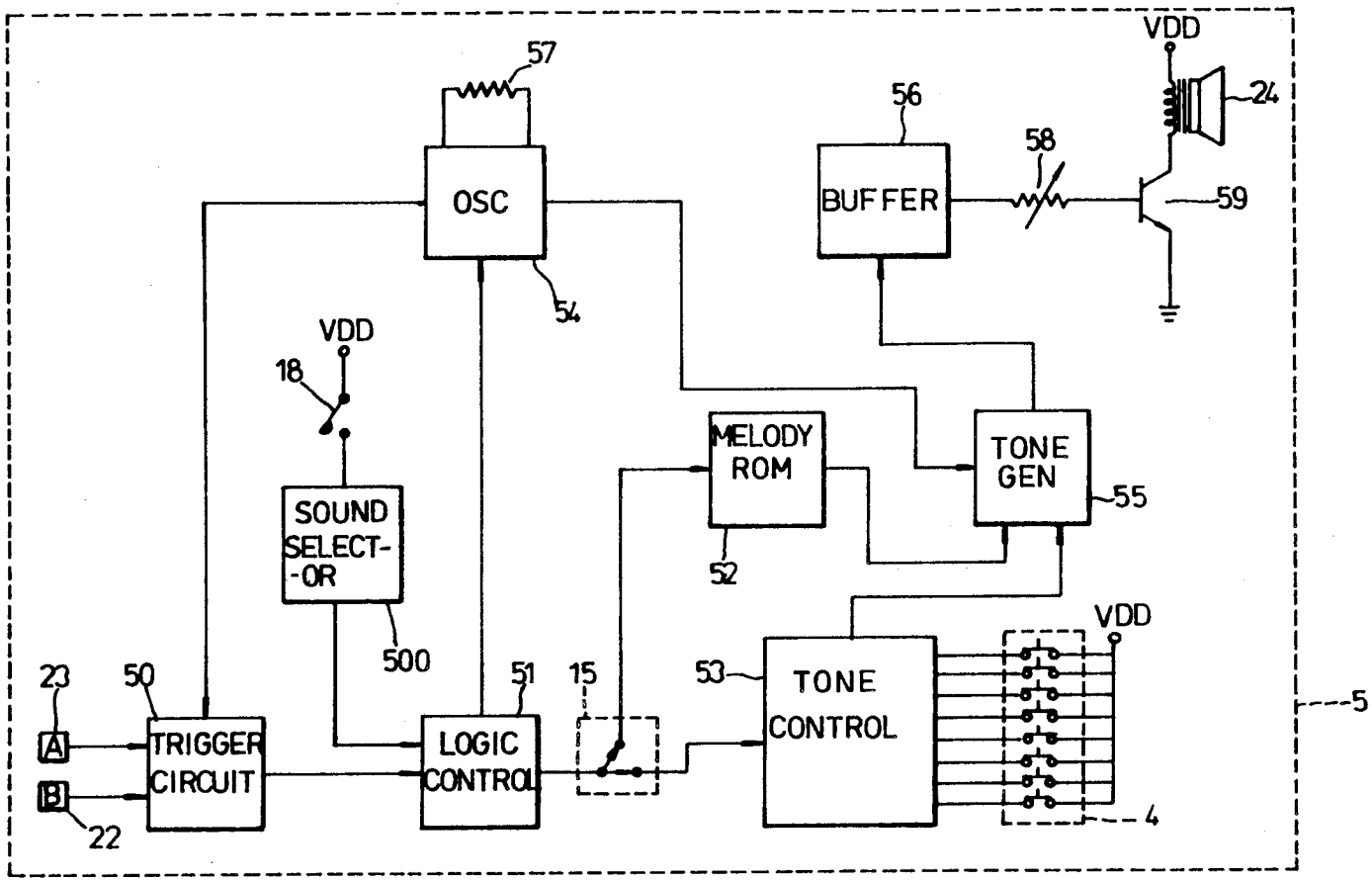
FIG. 5 is a control circuit of the present invention.

Refer to FIG. 3 to FIG. 5. When playing this toy, draw the bow 6 on the string-simulating plates 30 of the engaging member 3 which will incline to two sides, because the two axles 32 are fixed at the troughs 16. The two protuberances 31 then, will press two sides of the copper plate 23 down and touch the other copper plate 22 seperately but continuously which triggers the trigger circuit 50. With selecting switch 15 in the 'AUTO' position, the oscillating generator 64 will generate a basic frequency and also asist the tone generator 55 to acquire a standard musical scale. The trigger circuit 50 cycles the preset music in the melody ROM 52 transmit through the tone generator 55, the buffer 56, the varible transistor 68, the transistor 59 then output from the speaker 24.

When desired to play the present invention manually, first place the function selecting switch 15 to 'MANUAL' position then, draw the bow 6 on the string plates 30 of the engaging member 3 and the swing movement of the engaging member 3 will cause the two protuberances 31 to swing together and force on side of the higher positioned copper plate to move down and touch the lower positioned copper plate and trigger the trigger circuit 50. Players can press the keys 4 individually and each press shall make a different rhythm output through the speaker 24 and the player is able to produce any song that he thinks the best.

If the player presses two keys 4 at one time instead of one key 4, the speaker 24 shall output a chromatic scale.

If the player does not touch any of the keys 4, the speaker 24 shall output a basic tone 'DO'.

I claim:

1. A violin musical toy comprising:

a cover having a bulgy portion at its front and a bridge at its rear end and several string plates integral with a top surface and a hole in-between said bulgy portion and said bridge, said bulgy portion has several key holes, a song selection switch, a function selecting switch and several posts;

a body having a groove, a mounting aligned with said hole of said cover, a speaker at one side of said groove and a keyboard placed at the front end of said body, said body having several control points on said keyboard, each control point being aligned with one of said keyholes;

an engaging member placed in-between said mounting of said body and said bridge of said cover said engaging member having several string-simulating plates on top, two protuberances at two bottom ends and two axles at two sides;

several keys, each key having a hollow portion at its inside halfway from bottom to top and each accommodating a block which has half of its top inserted into said hollow portion and which has an electric rubber conductor at its center bottom and an elastic portion at its bottom portion; thus when drawing a bow on said string-simulating plates, said engaging member will incline to either of two sides and one of said two protuberances will press one copper plate down to touch another copper plate and trigger a control circuit to output a preset musical selection if said selecting switch is placed at an 'AUTO' position or to output different tones when different keys are pressed when said selecting switch is placed at a 'MANUAL' position.

2. The violin musical toy of claim 1, said control circuit having a trigger circuit, a logic control, a melody ROM a song selector, a tone control, an oscillating generator, a tone generator, a buffer, a resistor, a variable resistance, and a transistor; wherein said trigger circuit has its input terminal connected with said two copper plates of said body, respectively, said logic control is connected with said melody ROM and said tone control through said function selecting switch, said tone control is connected with said contact point of said keyboard and the output terminal of said buffer is connected with said variable resistor, said transistor and said speaker.

3. The violin musical toy of claim 2, wherein said oscillating generator is connected with said resistor to produce a basic frequency and to assist said tone control to produce a standard musical scale, and to output a basic tone 'DO' when said control circuit is triggered and said function selecting switch is placed at the 'MANUAL' position and no key has been pressed.

4. The violin musical toy of claim 1, wherein said speaker, when said function selecting switch is placed at the 'AUTO' position, will output a preset musical selection.

* * * * *